US006903306B2

(12) United States Patent
Moller

(10) Patent No.: US 6,903,306 B2
(45) Date of Patent: Jun. 7, 2005

(54) DIRECTIONAL COOLING SYSTEM FOR VACUUM HEAT TREATING FURNACE

(75) Inventor: Craig A. Moller, Roscoe, IL (US)

(73) Assignee: Ipsen International, Inc., Cherry Valley, IL (US)

( * ) Notice: Subject to any disclaimer, the term of this patent is extended or adjusted under 35 U.S.C. 154(b) by 0 days.

(21) Appl. No.: 10/621,145

(22) Filed: Jul. 16, 2003

(65) Prior Publication Data

US 2004/0007565 A1 Jan. 15, 2004

Related U.S. Application Data

(63) Continuation-in-part of application No. 10/154,457, filed on May 23, 2002.

(51) Int. Cl.[7] ..... F27D 11/00

(52) U.S. Cl. ..... 219/400; 219/390; 219/405; 392/416; 392/418; 118/724; 118/725; 266/217; 266/249; 266/250; 266/266; 266/270

(58) Field of Search ..... 219/390, 405, 219/411, 400; 392/416, 418; 118/724–725, 50.1; 266/217, 249–250, 266, 270

(56) References Cited

U.S. PATENT DOCUMENTS 2,734,738 A * 2/1956 Even ..... 266/266
4,285,504 A 8/1981 Colvin
4,610,435 A * 9/1986 Pfau et al. ..... 266/250
6,533,991 B1 3/2003 Moller
2002/0195439 A1 12/2002 Moller

OTHER PUBLICATIONS

Technical data. Seco/Warwick, Jun. 2001.

Technical data, Abar Ipsen.

Technical data, VFS, Sep. 1998.

* cited by examiner

*Primary Examiner*—Shawntina Fuqua
(74) *Attorney, Agent, or Firm*—Dann, Dorfman, Herrell and Skillman, P.C.

(57) ABSTRACT

A furnace for heat treating of metal parts includes a hot zone enclosure defining a hot zone therein. The hot zone enclosure has a side wall, a first end wall, and a second end wall. The side wall has slots formed therethrough and along the length thereof. The heat treating furnace also includes a system for injecting a cooling gas into the hot zone through the hot zone enclosure. The heat treating furnace further includes a damper arrangement for directing the cooling gas over a selected portion or portions of the workpiece load and through one or more of the slots. In one embodiment of the invention, all actuated components in the furnace are located outside of the hot zone to minimize damage to moving parts that are caused by exposure to extreme heat.

40 Claims, 8 Drawing Sheets

DIRECTIONAL COOLING SYSTEM FOR VACUUM HEAT TREATING FURNACE

RELATED APPLICATIONS

This continuation-in-part application claims priority under 35 U.S.C. §120 to U.S. application Ser. No. 10/154,457, filed May 23, 2002, which claims priority to U.S. application Ser. No. 09/597,496, filed Jun. 20, 2000, both of which are incorporated herein by reference in entirety.

FIELD OF THE INVENTION

The present invention relates to vacuum heat treating furnaces, and more specifically to a vacuum heat treating furnace having a precision-controlled, directional cooling system that provides uniform cooling of a workpiece load.

BACKGROUND

Known vacuum heat treating furnaces employ cooling gas injection systems to rapidly cool workpieces from the heat treating temperature. The workpieces are heated in a hot zone which is enclosed by a hot zone wall that retains heat inside the hot zone. After heat treatment, cooling gas is injected into the hot zone to cool the workpieces. The cooling gas flows across the hot zone to cool the workpieces and exits through one or more exit ports in the hot zone wall. The exit ports are typically small to minimize the escape of heat from the hot zone during heat treatment.

One problem with known vacuum treating furnaces occurs when the workpiece is not cooled uniformly. In many furnaces, the stream of cooling gas contacts one part of the workpiece load more than other parts, resulting in areas that receive too little or too much cooling. When workpieces are not cooled uniformly, the finished workpiece may not exhibit the desired properties, such as hardness and ductility. Non-uniform cooling is a common problem in systems that draw cooling gas to exit ports located at only one end of the hot zone. Non-uniform cooling is also a problem in furnaces where the flow of cooling gas is fixed in one configuration that cannot be adjusted or adapted to cool workpieces having different sizes and geometries.

Directional cooling systems have been developed to improve cooling by controlling the flow of cooling gas that enters the hot zone. In directional cooling systems, injection of cooling gas can be concentrated in different sections of the hot zone to cool specific areas of the workpiece. Although directional cooling systems provide better control of cooling gas entering the hot zone, the cooling gas stream is typically discharged from one end of the hot zone. As a result, the cooling gas stream is drawn to one section of the hot zone, which still results in uneven cooling along the length of the workpiece.

Another problem with known directional cooling systems is the placement of actuators, dampers, and other moving components in the hot zone. When moving components are routinely exposed to high temperatures in the hot zone, the components become damaged over time, increasing maintenance and equipment downtime. As a result, the known vacuum heat treating furnaces and cooling systems fall short of the needs of furnace users who desire uniform cooling of workpieces and reduced maintenance of their vacuum furnaces.

SUMMARY OF THE INVENTION

The above-described problems associated with the known vacuum heat treating furnaces are overcome to a large degree by the vacuum heat treating furnace in accordance with the present invention. According to a first aspect of the present invention, there is provided a heat treating furnace for providing directional cooling of a workpiece load. The heat treating furnace includes a hot zone enclosure defining a hot zone therein. The hot zone enclosure has a side wall, a first end wall, and a second end wall. The side wall has one or more slots formed therethrough and along the length thereof. The heat treating furnace also includes means for injecting a cooling gas into the hot zone through the hot zone enclosure. The heat treating furnace further includes means for directing the cooling gas to exit the hot zone enclosure through one or more of the slots.

In accordance with a second aspect of the present invention, there is provided a hot zone enclosure for a heat treating furnace. The hot zone enclosure includes a side wall and first and second end walls. The side wall has one or more slots formed therethrough and along the length thereof. The slots are covered to limit the escape of heat from the hot zone during heat treatment. In one embodiment of the invention, the slots are covered by actuated bungs. In another embodiment, the slots are aligned with stationary baffles spaced inwardly or outwardly from the slots.

BRIEF DESCRIPTION OF THE DRAWINGS

The foregoing summary as well as the following detailed description will be better understood when read in conjunction with the drawings in which.

DETAILED DESCRIPTION OF THE PREFERRED EMBODIMENT

Figure 1:
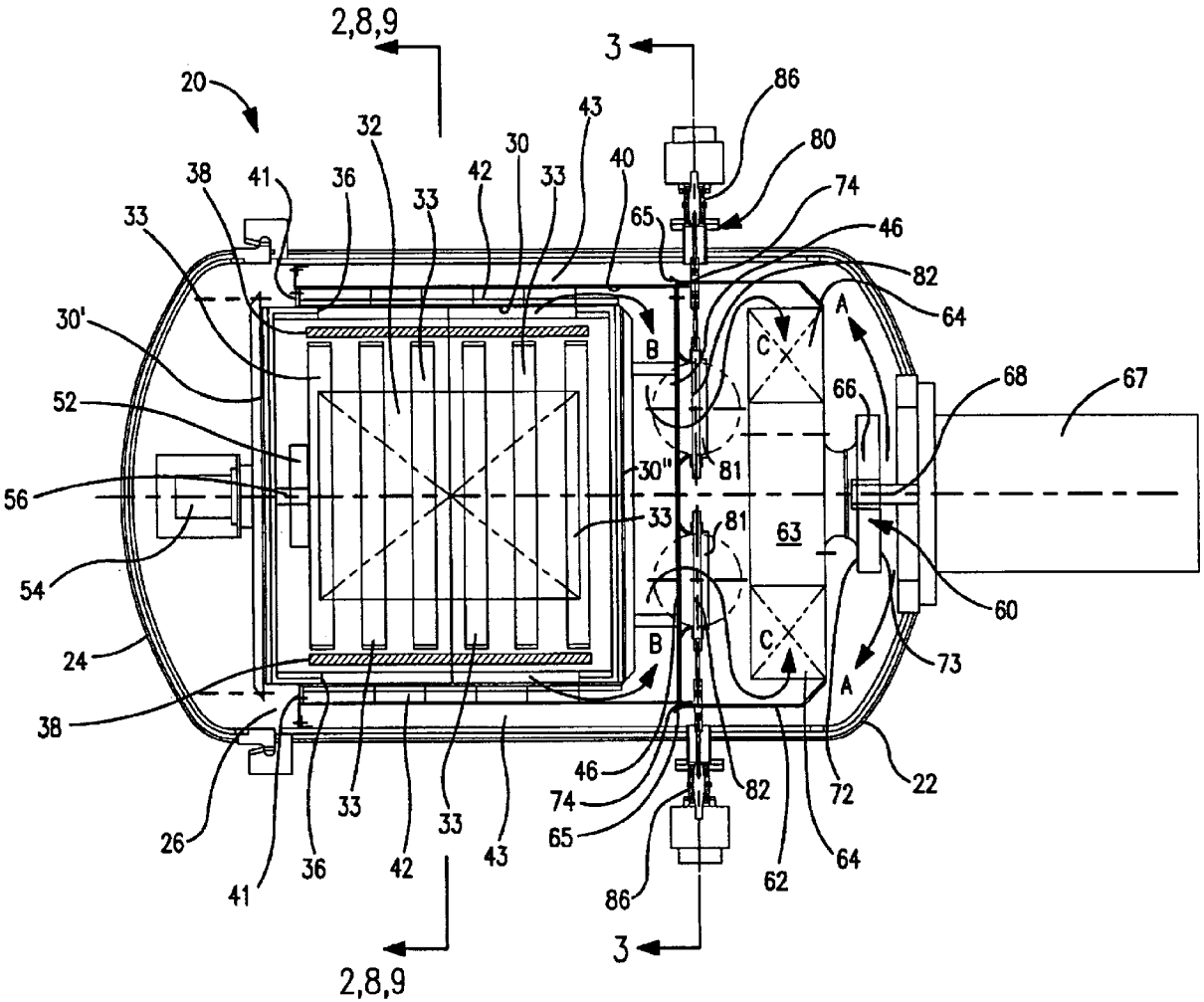
FIG. 1 is a top plan view in partial section of a vacuum heat treatment furnace in accordance with the present invention.

Referring now to the drawings, a heat treating furnace in accordance with the present invention is shown and designated generally as 20. The heat treating furnace 20 has a hot zone 32 that includes a side wall 30, a first end wall 30' and a second end wall 30". Cooling gas can be injected into the hot zone 32 and onto a workpiece from several angles relative to the workpiece. The cooling gas is injected through a plurality of nozzles 50 installed through the side wall 30. The side wall 30 has one or more elongated slots 36. In this manner the cooling gas is caused to flow uniformly over the length of the workpiece to provide efficient removal of heat and improve front to back cooling uniformity.

A damper assembly 80 is provided to control the direction and flow rate of the cooling gas stream through the hot zone 32. The damper assembly 80 has two or more dampers 82 that connect the hot zone 32 to a blower unit 60. Each damper 82 is located in proximity to one of the slots 36 and is adjustable to draw gas flow into the slot in closest proximity to the damper. The dampers 82 are operable individually or in combination to create a cooling gas stream with a desired magnitude and flow direction through the hot zone. The dampers 82 are controlled by actuators 86 that are thermally isolated from the hot zone 32, to prevent damage to the actuators from heat generated in the hot zone.

Figure 2:
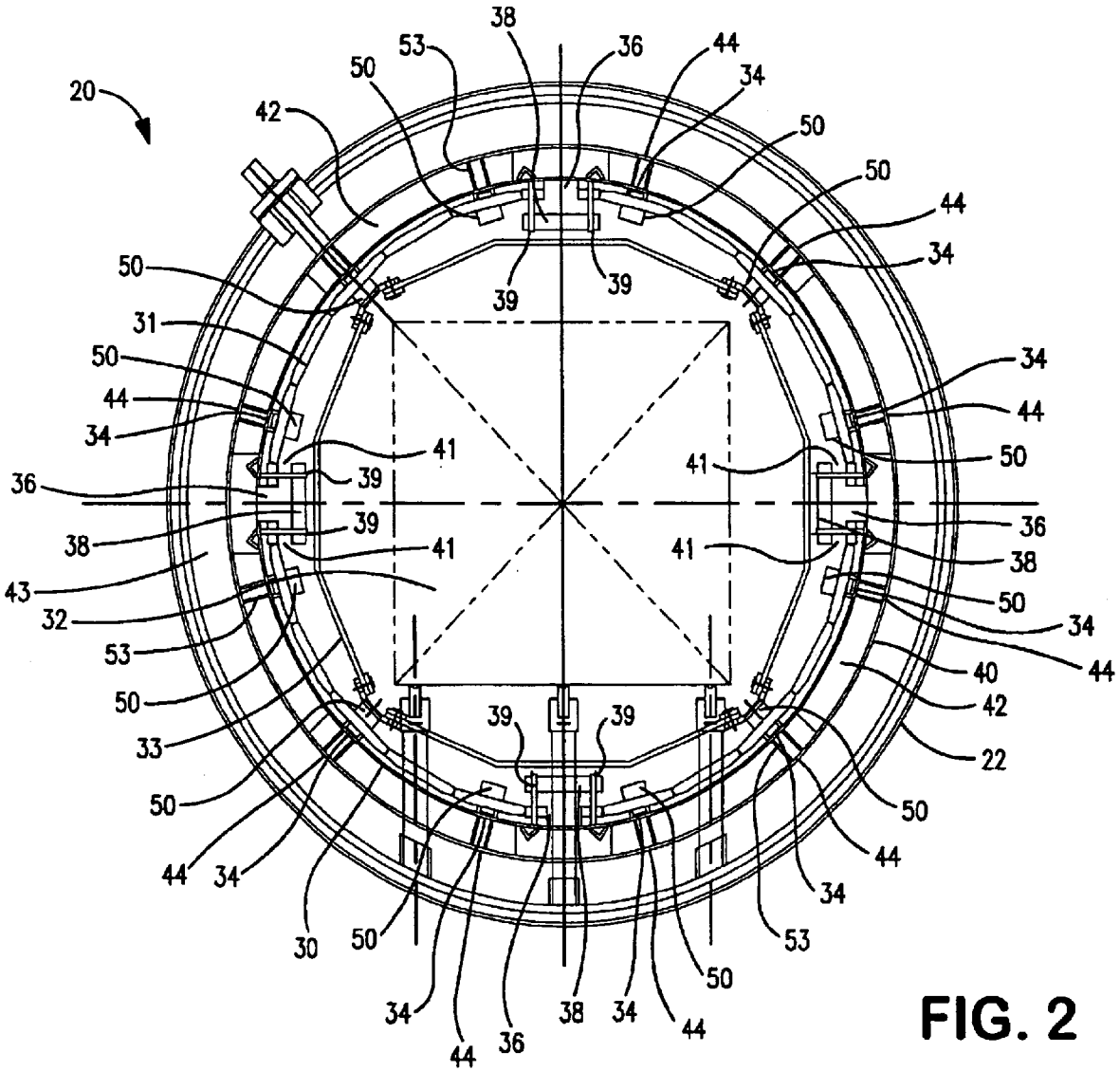
FIG. 2 is an end view in partial section of the vacuum heat treatment furnace in FIG. 1 as viewed along line 2—2 in FIG. 1.

Referring now to FIGS. 1 and 2, the furnace 20 will be described in greater detail. The furnace 20 may be constructed with a variety of exterior configurations and orientations. In FIG. 1, the furnace 20 is shown as a generally horizontal cylindrical vessel. The hollow interior of the furnace 20 is enclosed by a double outer wall 22 and a domed, double wall door 24. The double outer wall 22 has an open end 26 that is sealed by the door 24. The door 24 is preferably attached to the pressure vessel 22 by hinges and is movable to expose the open end 26 and provide access to the interior of the furnace 20.

The hot zone 32 has an array of heating elements 33 mounted inside the hot zone 32 for applying heat to a workpiece placed in the furnace. The heating elements 33 extend around the hot zone 32 and are arranged along the length of the hot zone 32 to distribute heat uniformly throughout the hot zone. The hot zone walls 30, 30', and 30" are configured to retain heat in the hot zone and minimize transfer of heat from the workpiece during heating. A variety of heat retention mechanisms may be used to retain heat in the hot, zone. As shown in FIG. 2, the hot zone 32 is surrounded by a thermal insulation layer 31 connected to the hot zone walls 30, 30', and 30".

Referring again to FIG. 1, a convection fan 52 is mounted inside the hot zone 32 and has a plurality of flat blades. The convection fan 52 is mounted on a shaft 56 driven by a motor 54 mounted in the door 24 outside the hot zone 32 between the end wall 30' and the outer wall of door 24. The motor 54 is operable to rotate the shaft 56 and fan 52 to provide convective heating in the hot zone during a heat treating cycle.

A heat shielded enclosure 40 is mounted inside the furnace 20 in the annular space between the double outer wall 22 and the hot zone wall 30. The enclosure 40 is connected to the interior surface of the double outer wall 22 by a welded flange or other means of support. An annular space or plenum 42 is formed between the side wall 30, the end wall 30", and the heat shielded enclosure 40. The enclosure 40 surrounds a portion of the side wall 30 and terminates near the end wall 30'. An end wall 41 connects the terminal end of the enclosure 40 to the side wall 30 such that the plenum 42 is substantially enclosed between the hot zone wall and enclosure, as shown in FIG. 1. An annular duct 43 is formed between the double outer wall 22 and the enclosure 40.

Cooling gas is injected into the hot zone 32 and removed from the hot zone in a closed loop system. As shown in FIG. 2, the duct 43 is operatively connected to the hot zone 32 by a plurality of conduits 53. The conduits 53 are arranged around the hot zone 32 so that the cooling gas can be introduced into the hot zone from several angles around the workpiece. The side wall 30 has a plurality of orifices 34 that are coaxially aligned with a plurality of orifices 44 extending through the enclosure 40. The conduits 53 extend between the orifices 34, 44 and through the plenum 42 to form a direct passage from the annular duct 43 to the hot zone 32. A plurality of gas injection nozzles 50 are mounted on the side wall 30 in communication with the conduits 53.

Referring now to FIGS. 4–7, the gas injection nozzles 50 (hereinafter "nozzles") will be described in greater detail. The nozzles 50 provide a means for injecting a cooling gas into the hot zone 32 during a forced gas cooling or quenching process. The nozzles 50 are also constructed to substantially prevent the egress of heat from the hot zone 32 during a heat treating cycle. A variety of structures may be used for the nozzles 50 to permit forced flow of cooling gas into the hot zone while impeding the convection of heat from the hot zone. In the preferred embodiment, the nozzles 50 have a flap valve 51. The nozzles 50 extend through the thermal insulation layer 31 and are attached to the side wall 30. A variety of fasteners may be used to secure the nozzles 50 to the side wall 30, including pins, bolts, wires, threads, twist-lock tabs, or retaining clips. The means for attaching the nozzle 50 to the side wall 30 preferably provides for easy installation and removal of the nozzle to facilitate assembly and maintenance of the heat treating furnace 20 and/or its hot zone 32.

Figure 4:
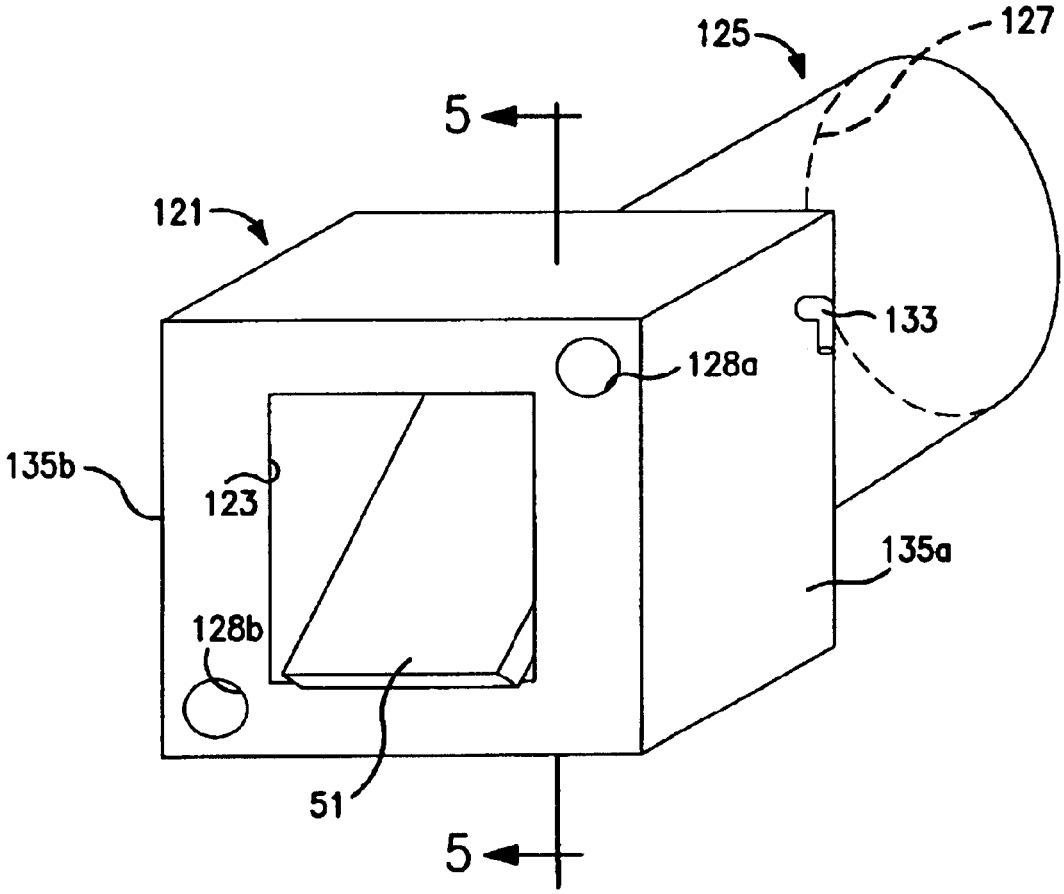
FIG. 4 is a perspective view of a cooling gas nozzle used with the vacuum heat treatment furnace in FIG. 1.
Figure 5:
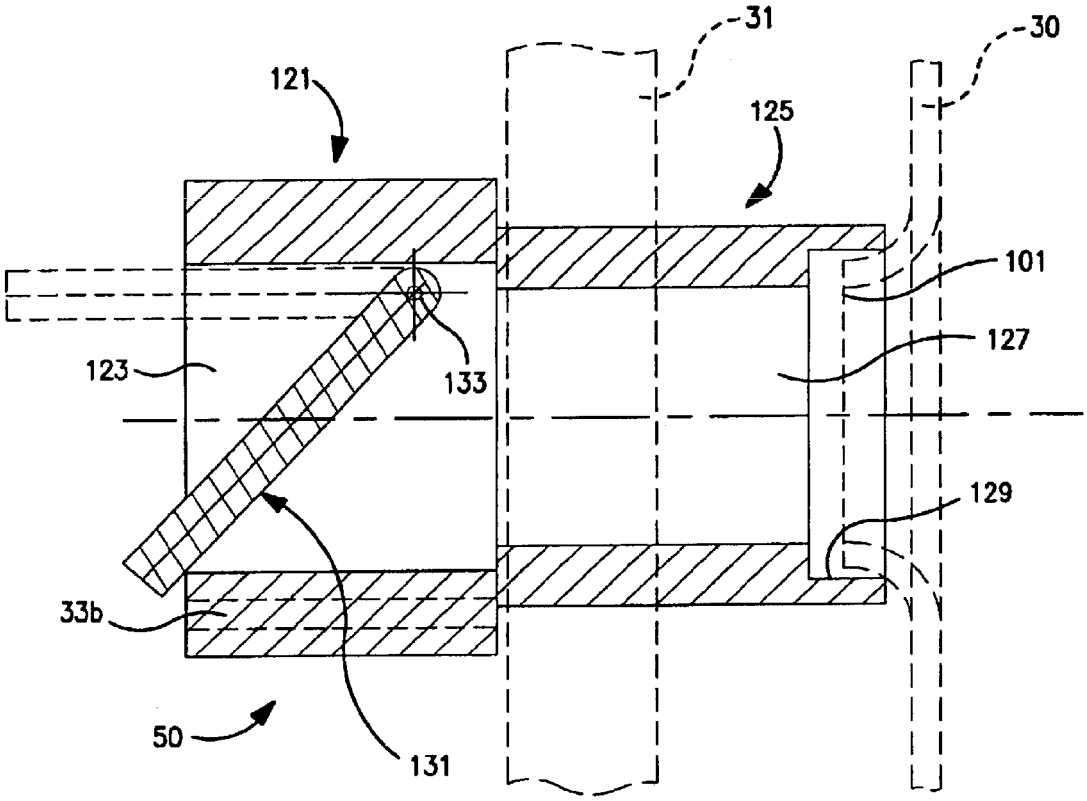
FIG. 5 is a partial sectional view of the cooling gas nozzle of FIG. 4 taken through line 5—5 in FIG. 4.

Referring now to FIGS. 4 and 5, there are shown the details of a preferred arrangement for a gas injection nozzle 50. The gas injection nozzle 50 is formed of a forward portion 121 which is exposed in the hot zone 32 and a rear portion 125 which extends through the insulation layer 31 and is attached to the side wall 30. A first central opening 123 is formed through the length of the forward portion 121 and a second central opening 127 is formed through the length of the rear portion 125. The first central opening 123 and the second central opening 127 are aligned to form a continuous channel through the nozzle 50. The rear portion 125 has an annular recess 129 formed at the end thereof. The annular recess 129 is formed to accommodate a rounded flange or collar 101 that extends inwardly from the side wall 30 at an orifice 34.

Figure 6:
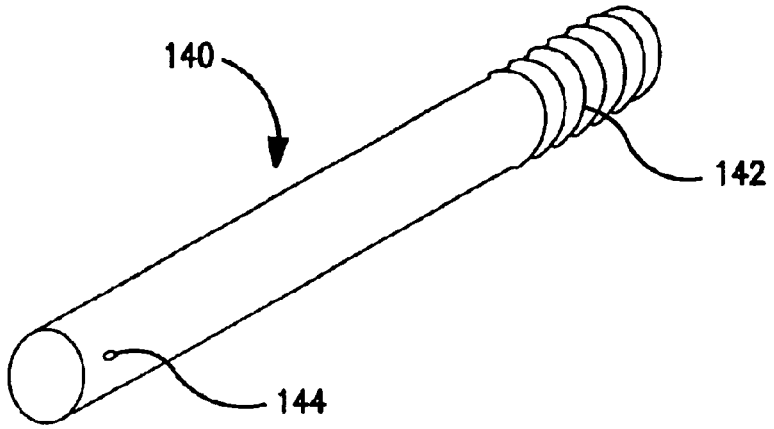
FIG. 6 is a perspective view of a pin that may be used with the cooling gas nozzle in FIG. 4.

A pair of boreholes **128*a* and 128*b* are formed or machined in the forward portion 121 of nozzle 50 for receiving the fasteners that attach the nozzle 50 to the side wall 30. A preferred construction for the fastener is shown in FIG. 6. A pin 140 has a first end on which a plurality of screw threads 142 are formed to permit the pin 140 to be threaded into a threaded hole in the hot zone wall. It will be appreciated that instead of the screw threads 142, the first end of pin 140 can be provided with twist-lock tabs, or a transverse hole for accommodating a retaining clip. The other end of the attachment pin 140 has a transverse hole 144 formed therethrough for receiving a retaining clip to hold the nozzle 50** in place.

Figure 7:
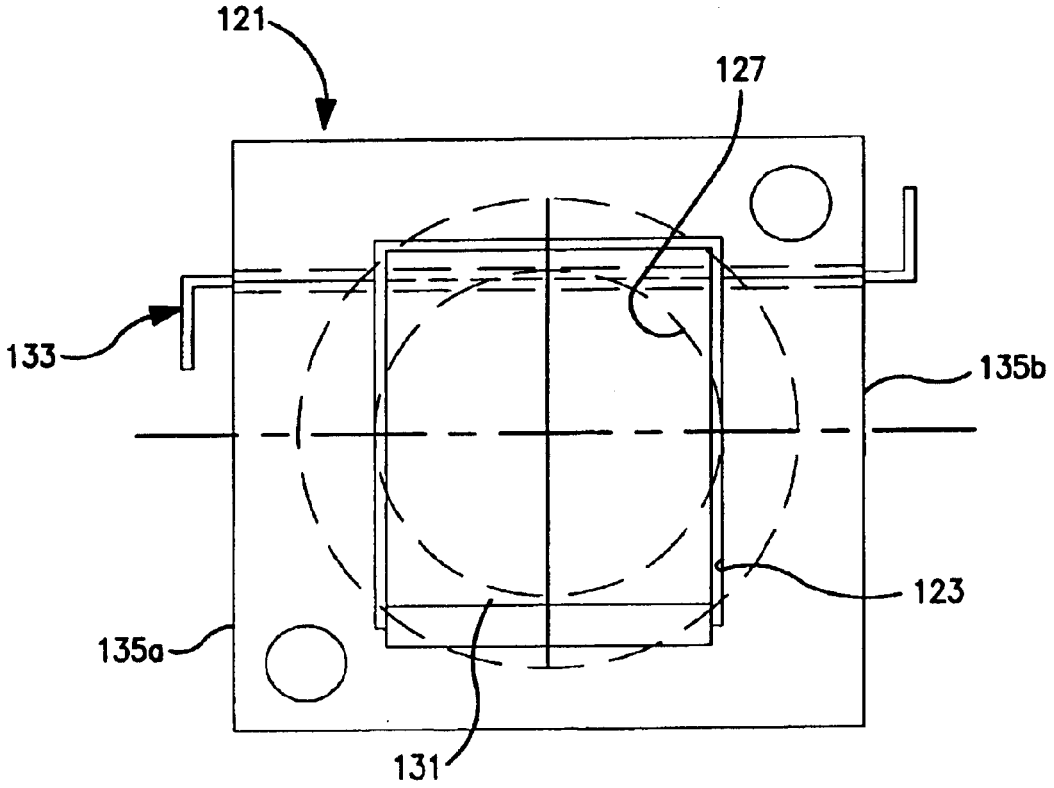
FIG. 7 is a rear elevation view of the cooling gas nozzle of FIG. 4.

Referring to FIGS. 5 and 7, a flap 131 is disposed in the first central opening 123 and is pivotally supported by a pin 133 which traverses holes in sidewalls **135*a* and 135*b* of forward portion 121. The flap 131 is positioned and dimensioned so as to close the central opening 123 when it is in a first position, thereby preventing, or at least substantially limiting, the transfer of heat out of the hot zone 32 and the unforced introduction of cooling gas into the hot zone through the central channel of the nozzle. In a second position of the flap 131, as shown in phantom in FIG. 5, the central opening 123 is open to permit the forced flow of cooling gas through the nozzle 50 and into the hot zone 32 during a cooling or quenching cycle. The position of the flap 131 relative to the central channel may be influenced by gravity, depending on the position and orientation of the nozzle 50 on the side wall 30. In some sections on the side wall 30, the flap 131 is maintained in the first or closed position by the force of gravity. In other areas of the side wall 30, the flap 131 may be pivoted toward the second or open position under the force of gravity, leaving the nozzles open. For this latter set of nozzles, biasing means, such as a counterweight or a spring, can be used to maintain the flaps 131 in the closed position. The biasing means should provide a biasing force strong enough to maintain the flaps 131 in the normally closed position against the force of gravity, but less than the force of the cooling gas on the flap when cooling gas is being injected. In this way, the flap 131 can be maintained in the closed position during heat treatment and be readily pivoted to the open position when cooling gas is injected through the nozzle 50**.

The nozzle 50 and the flap 131 are preferably formed from a refractory material such as molybdenum or graphite. They may also be formed of a ceramic material if desired. In the embodiment shown, the forward portion 121 is rectangular in cross section and the rear portion 125 is circular in cross section. However, the shapes of the forward and rear portions of nozzle 50 are not critical. Preferably, the forward portion 121 has a larger cross-sectional area than the rear portion 123 so that the forward portion 121 will press against the thermal insulation 31 to help keep it in place during operation of the heat treating furnace. Similarly, the shapes of the first and second central openings 123 and 127 are not critical. The first central opening 123 is preferably square or rectangular for ease of fabrication and the second central opening 127 is preferably circular for ease of adaptation with the opening in the side wall 30.

The side wall 30 has a structure that allows uniform application and removal of cooling gas along the length of the workpiece. The cross section of the side wall 30 may have any of a variety of shapes, including circular, square, rectangular, polygonal, or other cross sectional shape. In the preferred embodiment, the side wall 30 is cylindrical, as shown in FIG. 2. The nozzles 50 are arranged around the cylindrical wall to inject cooling gas radially inwardly onto the workpiece from a plurality of locations around the workpiece. One or more slots 36 extend along the side wall 30 and connect the hot zone 32 to the plenum 42. The slots 36 may have any shape and dimension to provide a passage for removing heat uniformly along the length of the hot zone 32 and workpiece. In addition, the side wall 30 may have several slots formed therein. As shown in FIGS. 1 and 2, the side wall 30 has four linear slots 36 offset from each other at about 90° intervals around the circumference of the wall. The slots 36 extend substantially the length of the side wall 30 so that injected cooling gas can form a gas stream that exits through the slots along the length of the hot zone 32 in a uniform manner.

The slots 36 cooperate with means for limiting the escape of heat from the hot zone during a heating cycle. The slots 36 may be covered by actuated bungs that are operable in an open condition to allow cooling gas to discharge from the hot zone during a cooling cycle, and in a closed position to minimize the escape of heat from the hot zone by convection during a heating cycle. In the preferred embodiment, the slots are covered by a plurality of baffles 38 that are radially aligned with the longitudinal slots 36 and spaced therefrom. The baffles 38 are formed of a thermal insulating material and dimensioned to substantially cover the slots 36. In this way, the baffles 38 minimize the escape of heat from the hot zone 32 by convection during a heating cycle. The baffles 38 are stationary with no actuated components or moving parts. As a result, the baffles are less susceptible to the types of damage and wear that occur when actuated parts are repeatedly exposed to heat from the hot zone.

The baffles 38 may be positioned radially inwardly from the slots 36 into the hot zone 32, as shown in FIG. 2. Alternatively, the baffles 38 may be installed radially outwardly from the slots 36 in the plenum 42. In either case, the baffles 38 form gaps 41 between the edges of the baffles and the hot zone side wall. The gaps 41 provide passages between the hot zone 32 and plenum 42 to permit cooling gas to exit the hot zone during cooling gas injection. Any of a variety of connectors may be used to support the baffles 38 in the hot zone or plenum. In FIG. 2, the baffles 38 are supported by a pair of rods 39 mounted to the inside of the side wall 30. The rods 39 are preferably formed of a high strength, high temperature material, such as carbon/carbon or molybdenum. During a cooling cycle, the cooling gas flows around the baffles 38 and rods 39 and exits through the slots 36 into the plenum 42.

Referring back to FIG. 1, the cooling gas injection system will be described in more detail. Cooling gas is conveyed in a closed loop system that supplies forced cooling gas into the hot zone 32 and removes heated gas from the hot zone. The cooling gas is recirculated through the annular duct 43, hot zone 32, and plenum 42 by a blower unit 60 mounted between the double outer wall 22 and the heat shielded enclosure 40. The blower unit 60 has a housing 62 that adjoins one end of the heat shielded enclosure 40. A blower fan 66 is mounted in the blower unit 60 and has a suction end 72 and a discharge end 73. The blower fan 66 has a plurality of fan blades mounted on a drive shaft 68. The drive shaft 68 is connected to and driven by a motor 67. In the preferred embodiment, the motor 67 is mounted outside the double outer wall 22 of the furnace, and the shaft 68 extends through the double outer wall. In this way, the motor 67 is readily accessible for repairs on the outside of the furnace 20. In addition, the motor 67 is not subjected to the extreme heat generated inside the hot zone 32. The blower fan 66 is operable to force cooling gas through the duct 43 and into the nozzles 50 with sufficient pressure to inject the gas past the flaps 131 and into the hot zone 32. The direction of cooling gas flowing through the duct 43 is shown by the arrows "A" in FIG. 1. The gas enters the hot zone through the cylindrical hot zone wall 30 and contacts the workpiece from about 360° around the workpiece. In this way, the cooling gas contacts the workpiece evenly on all sides. Cooling gas flows across the surface of the workpiece and absorbs heat from the workpiece.

The blower unit 60 is connected in communication with the plenum 42 and is operable to draw the heated gas from the hot zone 32 and into the plenum 42. The direction of cooling gas flowing through the plenum 42 is shown by arrows marked "B" in FIG. 1. The plenum 42 and housing 62 of the blower unit 60 are connected by exit ports or openings 46 in an end wall of the heat shielded enclosure 40. When the blower fan 66 operates, it creates a suction draft in the housing 62 and plenum 42. The suction in the plenum 42 draws heated cooling gas out of the hot zone 32 and through the longitudinal slots 36.

Figure 3:
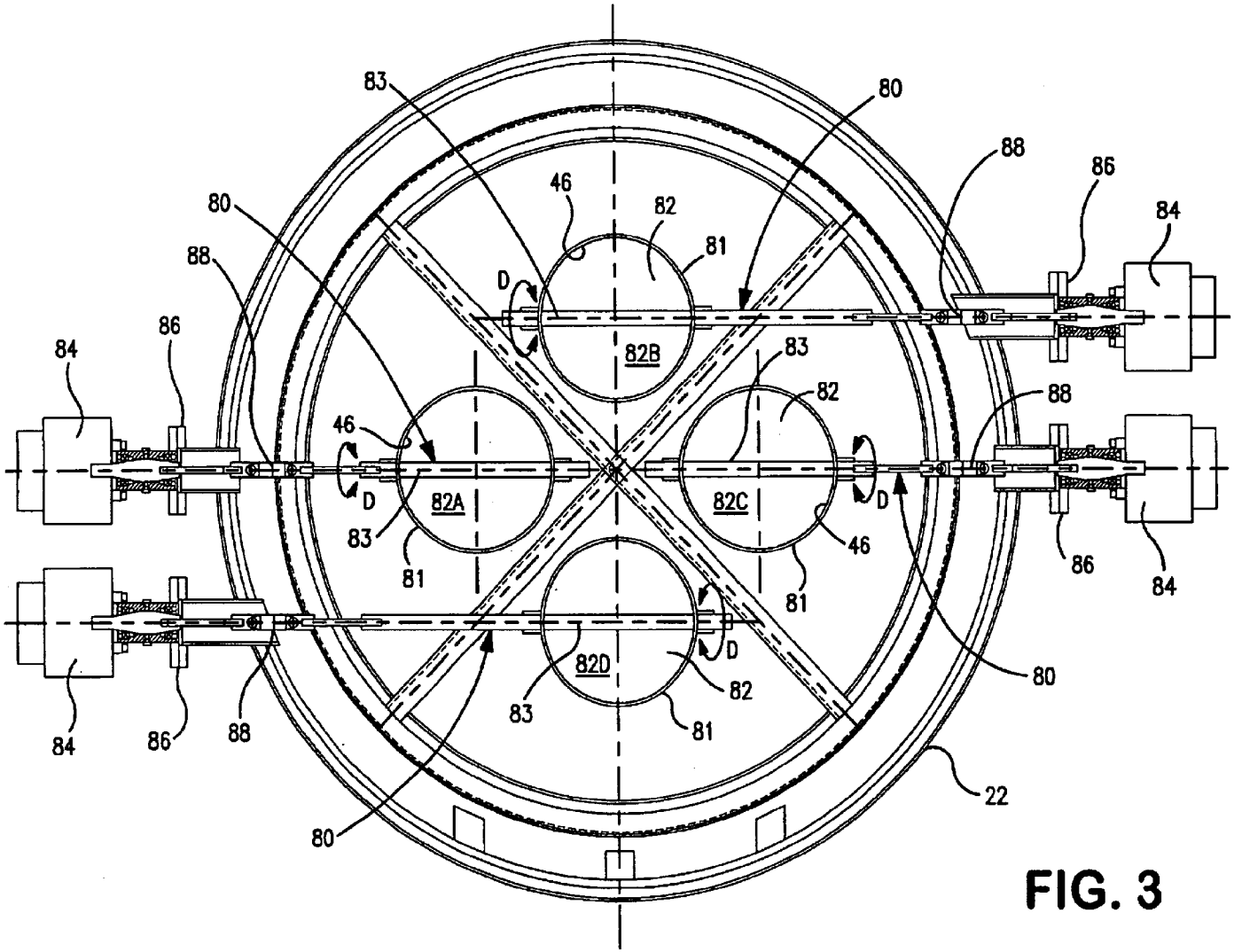
FIG. 3 is an end view in partial section of the vacuum heat treatment furnace in FIG. 1 as viewed along line 3—3 in FIG. 1.

Referring now to FIGS. 1 and 3, the heat shielded enclosure 40 preferably has four exit ports 46. For clarity, only two exit ports 46 are shown in FIG. 1. The exit ports 46 are generally positioned in axial alignment with the four longitudinal slots 36 on the hot zone wall 30. Each exit port 46 forms a passage that permits heated cooling gas to be drawn from the plenum 42 into the blower housing 62. Cooling gas that enters the blower housing 62 is drawn toward the suction end 72 of the blower fan 66.

As shown in FIG. 1, the blower unit 60 includes one or more heat exchangers 64 located in proximity to the suction end 72 of the blower fan 66. The heat exchangers 64 each contain a heat transfer surface, such as tubing coils, that contacts the stream of heated cooling gas as the gas is pulled toward the suction end 72 of the blower fan 66. The heat transfer surface removes heat from the cooling gas to lower the temperature of the gas. After the temperature of the cooling gas is lowered, the blower unit 60 recycles the cooling gas back to the hot zone 32. Any of a variety of liquid coolants or refrigerants can be circulated through the tubing coils to act as a heat sink. The blower unit 60 has a manifold 63 with two or more inlets adapted to receive the heated cooling gas. For clarity, the manifold 63 in FIG. 1 is shown with two inlets. The manifold 63 has an outlet in proximity to the suction end 72 of the blower fan 66. As such, the suction end 72 of blower fan 66 is operable to draw the cooling gas from the blower housing 62 into the inlets of manifold 63, as shown by the arrows marked "C", and through the heat exchanger 64. The cooled gas is then drawn out of the manifold 63 and into the suction end 72 of blower fan 66. The blower fan 66 discharges the cooling gas through the discharge end 73 of the fan. The discharge end 73 of the blower fan 66 is positioned in the duct 43 such that cooling gas is forced out of the fan and into the duct, as shown by the arrows marked "A". The blower fan provides a back pressure or draft in the duct 43 to force cooling gas through the duct and into the nozzles 50. The back pressure is sufficient to open the flaps 131 in the nozzles 50 so that the gas can be injected into the hot zone 32.

As stated earlier, the duct 43 conveys forced cooling gas to the hot zone 32, and the plenum 42 directs heated cooling gas from the hot zone to the suction side the blower unit 60. In addition, the duct 43 is preferably sealed from the plenum 42 and blower housing 62 to prevent leaking of forced cooling gas from the duct into the return flow. The wall of the blower housing 62 has a flared edge 65 that fits around the wall of the heat shielded enclosure 40. The edge of housing 62 and the edge of enclosure 40 form an annular recess that is filled by a ring shaped seal 74 to prevent cooling gas from leaking from the duct 43 into the housing 62. The seal 74 is preferably formed of a heat resistant material, such as aluminum oxide or other technical ceramic material.

The furnace 20 has a directional cooling feature that permits the cooling gas stream to be manipulated in a variety of flow patterns to cool a workpiece in a selected manner. The flow pattern of the cooling gas in the hot zone is manipulated by controlling the amount of suction present at each longitudinal slot 36. By controlling the amount of suction at each longitudinal slot 36, the cooling gas stream is directed toward some of the slots and converges toward specific areas of the workpiece in the hot zone 32. The exit ports 46 are configured to be fully opened, fully closed, or partially open. Allocation of the suction is regulated by controlling the extent to which each exit port is open or closed. By closing an exit port completely, the suction generated by the blower fan 66 through that exit port is cut off. This provides more suction at the slots located in proximity to other ports that are open.

The exit ports 46 may be operated with any of a variety of mechanisms in a wide range of configurations. As shown in FIGS. 1 and 3, each exit port 46 is circular and has an associated damper assembly 80. Each damper assembly 80 has a circular frame 81 that is aligned with an exit port 46. The frames 81 extend from the wall of the blower housing 62, and into the housing. A disk shaped damper 82 is rotatably mounted inside each frame 81 and has a diameter generally equal to the diameter of the frame 81. The dampers 82 are mounted on shafts 83 that extend through the side of the frames 81. The shafts 83 are rotatable to pivot the dampers 82 inside the frames 81. As shown in FIG. 3, the rotation of each damper disk 82 is illustrated by the arrows marked "D". Each damper 82 is pivotable to a fully open position, a fully closed position, and an infinite number of positions in between the fully open and fully closed positions. In the fully open position, the circumference of the damper 82 is oriented in a plane essentially parallel to the longitudinal axis of the frame 81. As such, the exit port 46 is virtually unobstructed by the damper 82, allowing a maximum flow of cooling gas through the exit port 46. In the fully closed position, the circumference of the damper 82 is oriented in a plane essentially normal to the longitudinal axis of the frame 81. In this position, the exit port 46 is substantially closed to gas flow by the damper 82.

Each shaft 83 is operatively connected to and rotatable by an actuator 86. Any of a variety of actuators 86 may be used, including electric actuators or pneumatic actuators. The actuators 86 are located on the outside of the double outer wall 22. In this way, the actuators 86 are not subjected to the intense heat generated by the heating elements in the furnace 20. The actuators 86 are connected to their respective shafts 83 by linkages 88 that extend through the housing wall of the blower unit 60. The linkages 88 are preferably formed of a flexible material that allows the linkages to deflect as the walls of the housing 62 shift under thermal expansion and contraction. The damper assemblies 80 are independently operable and controlled by a central processor (not shown). Each actuator 86 is controlled by a signal positioner 84 that responds to electrical signals from the processor. The signal positioners 84 and actuators 86 convert signals from the processor into mechanical rotation of the shaft 83 to adjust the position of the dampers 82. The processor is operable to precisely control the angular position of the dampers 82 and adjust the dampers to create a desired flow pattern of cooling gas in the hot zone.

Operation of the directional cooling system in the furnace 20 will now be described in more detail. The dampers 82 are operable to adjust the direction of cooling gas flow in the hot zone, as stated earlier. For example, one damper 82 may be open while the other dampers are closed to concentrate the cooling gas stream at one side of the hot zone 32. The dampers 82 are also operable through modulation to adjust the magnitude of flow through each exit slot 36 in the hot zone side wall 30. For example, some dampers 82 may be pivoted to the fully open position while others are modulated at an angle between the fully open position and fully closed position to partially obstruct the flow of cooling gas through the corresponding exit port 46. The furnace 20 may be operated with an infinite number of damper settings to provide an appropriate cooling gas stream for a particular workpiece shape.

Figure 8:
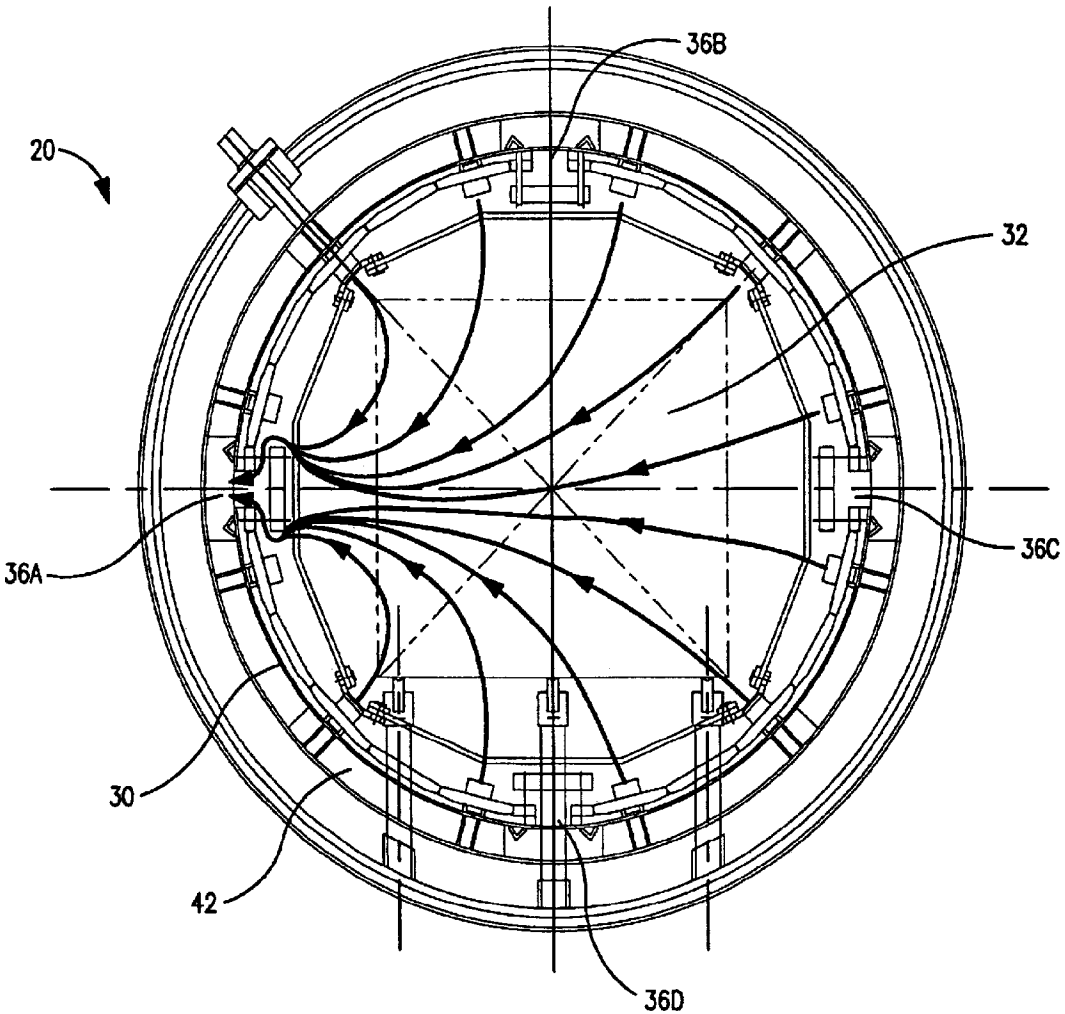
FIG. 8 is a side sectional view of the vacuum heat treatment furnace of FIG. 1 as viewed along line 8—8 in FIG. 1.

Referring now to FIGS. 3 and 8, one of the operating modes of the directional cooling system will be described. The furnace 20 has four dampers, 82A, 82B, 82C and 82D, which are disposed adjacent to exit ports 46A, 46B, 46C, and 46D, respectively. The exit ports 46A, 46B, 46C, and 46D are generally aligned with longitudinal slots 36A, 36B, 36C and 36D, respectively. The flow pattern of the cooling gas is illustrated when damper 82A is in an open position and dampers 82B–82D are in their closed positions. In this operating mode, the suction generated by the blower fan 66 is concentrated through the exit port 46A. Since longitudinal slot 36A is located closest to that exit port the suction generated by blower 60 is concentrated substantially entirely at slot 36A. Therefore, the heated cooling gas in hot zone 32 is drawn preferentially to slot 36A. The cooling gas converges around the side of the workpiece nearest slot 36A and exits through slot 36A into the plenum 42. It will be readily apparent that the cooling gas can be conducted to any of the slots 36A, 36B, 36C, or 36D in the hot zone side wall 30 by opening the corresponding damper that is nearest to that slot and keeping the other dampers closed.

Figure 9:
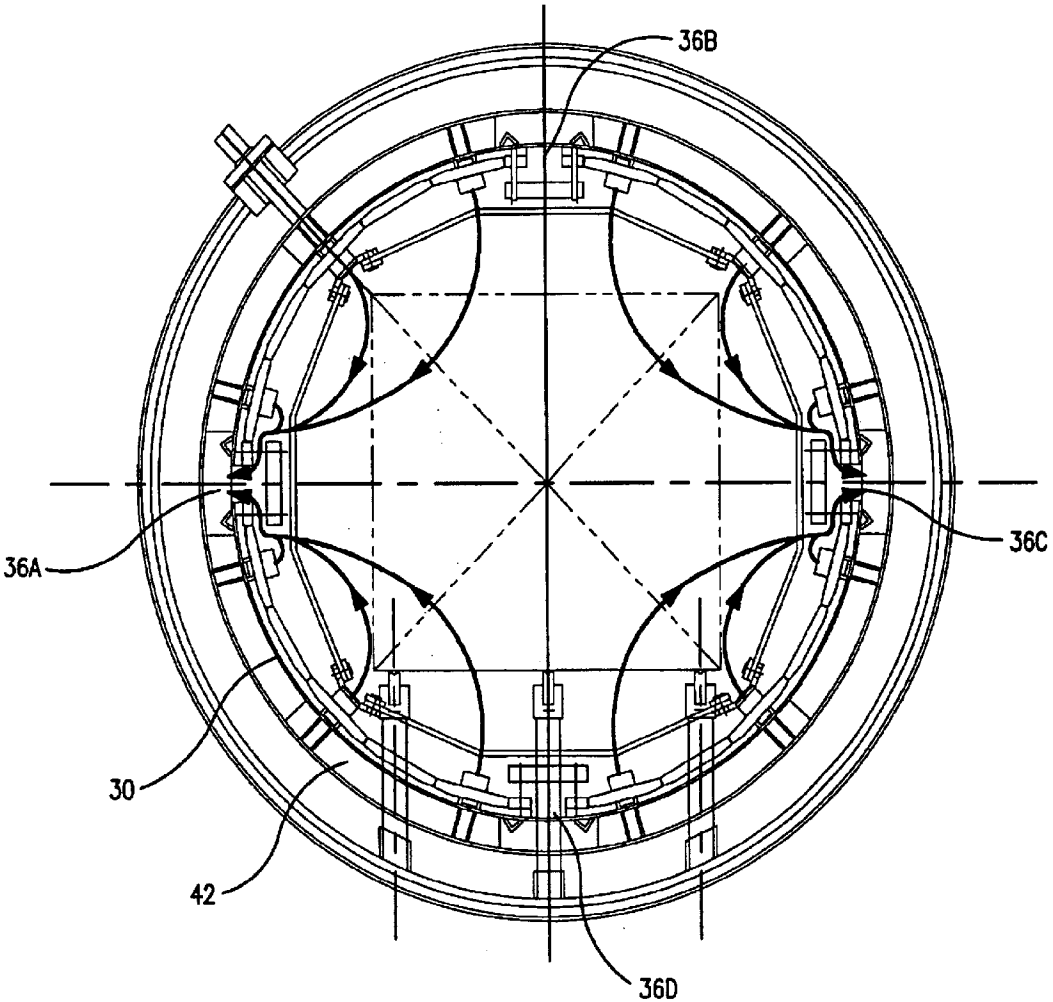
FIG. 9 is a side sectional view of the vacuum heat treatment furnace of FIG. 1 as viewed along line 9—9 in FIG. 1.

Referring now to FIG. 9, there is shown a second operating mode of the directional cooling system. In this mode the diametrically opposite dampers 82A and 82C are open. With this configuration, the suction generated by the blower 60 is divided between the exit ports 46A and 46C. Since longitudinal slots 36A, 36C are generally aligned with exit ports 46A and 46C, respectively, the suction draft is concentrated at slots 36A and 36C. The resulting gas flow in the hot zone is illustrated in FIG. 9. In this operating mode, the cooling gas is drawn preferentially around two sides of a workpiece to form a flow pattern that provides more uniform cooling around the geometry of the workpiece.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

What is claimed is:

1. A heat treating furnace for providing directional cooling of a workpiece load, comprising:

A. a cylindrical hot zone enclosure defining a hot zone therein, said hot zone enclosure having a side wall, a first end wall, and a second end wall, said side wall having first and second slots formed therethrough and along the length thereof;

B. means for injecting a cooling gas into the hot zone through said hot zone enclosure;

C. means for directing the cooling gas to exit the hot zone enclosure through one or both of said slots;

D. first and second elongated baffles disposed over the first and second slots, respectively; and E. means for supporting said first and second baffles in spaced relation from said first and second slots.

2. The heat treating furnace of claim 1 wherein the first slot is positioned diametrically opposite the second slot in the side wall of said hot zone enclosure.

3. The heat treating furnace of claim 1 wherein the cooling gas directing means comprises:

a plenum formed around said hot zone enclosure, said plenum having an end wall disposed in parallel relation to the second end wall of said hot zone enclosure, said plenum end wall having first and second openings formed therein such that said first opening is positioned in proximate relation to the first slot and said second opening is positioned in proximate relation to said second slot;

a first damper disposed in proximate relation to the first opening for regulating flow of the cooling gas therethrough;

a second damper disposed in proximate relation to the second opening for regulating flow of the cooling gas therethrough; and means for selectively moving one or both of said first and second dampers between an open position and a closed position.

4. A heat treating furnace for providing directional cooling of a workpiece load, comprising:

A. a hot zone enclosure defining a hot zone therein, said hot zone enclosure having a side wall, a first end wall, and a second end wall, said side wall having first and second slots formed therethrough and along the length thereof;

B. means for injecting a cooling gas into the hot zone through said hot zone enclosure;

C. means for directing the cooling gas to exit the hot zone enclosure through one or both of said slots;

D. first and second elongated baffles disposed over the first and second slots, respectively, and E. means for supporting said first and second baffles in spaced relation from said first and second slots.

5. The heat treating furnace of claim 1 wherein the cooling gas injecting means comprises a plurality of nozzles extending through the side wall of said hot zone enclosure, said nozzles each comprising a flap valve that permits forced flow of the cooling gas into the hot zone, but impedes unforced flow of a heat treating gas out of the hot zone.

6. The heat treating furnace of claim 1 wherein the side wall of the hot zone enclosure has a third slot formed through said hot zone enclosure and along the length thereof.

7. A heat treating furnace for providing directional cooling of a workpiece load, comprising;

A. a hot zone enclosure defining a hot zone therein, said hot zone enclosure having a side wall, a first end wall, and a second end wall, said side wall having first, second and third slots formed therethrough and along the length thereof;

B. means for injecting a cooling gas into the hot zone through said hot zone enclosure;

C. means for directing the cooling gas to exit the hot zone enclosure through one or more of said slots;

D. first, second, and third elongated baffles disposed over the first, second, and third slots, respectively, and E. means for supporting said first, second, and third baffles in spaced relation form said first, second, and third slots, respectively.

8. The heat treating furnace of claim 6 wherein the first, second, and third slots are spaced from one another.

9. The heat treating furnace of claim 8 wherein the cooling gas directing means comprises:

a plenum formed around said hot zone enclosure, said plenum having an end wall disposed in parallel relation to the second end wall of said hot zone enclosure, said plenum end wall having first, second, and third openings formed therein such that said first opening is positioned in proximate relation to the first slot, said second opening is positioned in proximate relation to said second slot, and said third opening is positioned in proximate relation to said third slot;

a first damper disposed in proximate relation to the first opening for regulating flow of the cooling gas therethrough;

a second damper disposed in proximate relation to the second opening for regulating flow of the cooling gas therethrough; and a third damper disposed in proximate relation to the third opening for regulating flow of the cooling gas therethrough; and means for selectively moving one or more of said first, second, and third dampers between an open position and a closed position.

10. The heat treating furnace of claim 6 wherein the side wall of the hot zone enclosure has a fourth slot formed through said hot zone enclosure and along the length thereof.

11. A heat treating furnace for providing directional cooling of a workpiece load, comprising:

A. a hot zone enclosure defining a hot zone therein, said hot zone enclosure having a side wall, a first end wall, and a second end wall, said side wall having first, second, third and fourth slots formed therethrough and along the length thereof:

B. means for injecting a cooling gas into the hot zone through said hot zone enclosure;

C. means for directing the cooling gas to exit the hot zone enclosure through one or more of said slots; and D. first, second, third, and fourth elongated baffles disposed over the first, second, third and fourth slots, respectively, and means for supporting said first, second, third, and fourth baffles in spaced relation from said first, second, third, and fourth slots, respectively.

12. The heat treating furnace of claim 10 wherein the first, second, third, and fourth slots are spaced from one another.

13. The heat treating furnace of claim 10 wherein the cooling gas directing means comprises:

a plenum formed around said hot zone enclosure, said plenum having an end wall disposed in parallel relation to the second end wall of said hot zone enclosure, said plenum end wall having first, second, third, and fourth openings formed therein such that said first opening is positioned in proximate relation to the first slot, said second opening is positioned in proximate relation to said second slot, said third opening is positioned in proximate relation to said third slot, and said fourth opening is positioned in proximate relation to said fourth slot;

a first damper disposed in proximate relation to the first opening for regulating flow of the cooling gas therethrough;

a second damper disposed in proximate relation to the second opening for regulating flow of the cooling gas therethrough;

a third damper disposed in proximate relation to the third opening for regulating flow of the cooling gas therethrough;

a fourth damper disposed in proximate relation to the fourth opening for regulating flow of the cooling gas therethrough; and means for selectively moving one or more of said first, second, third, and fourth dampers between an open position and a closed position.

14. The heat treating furnace of claim 12 wherein the first and second slots are positioned diametrically opposite one another and the third and fourth slots are positioned diametrically opposite one another.

15. The heat treating furnace of any of claims 1–14 comprising a blower having an exhaust in fluid communication with the hot zone for providing a cooling gas thereto and an intake in fluid communication with the hot zone for receiving the cooling gas therefrom, whereby the cooling gas can be recirculated through the hot zone.

16. The heat treating furnace of claim 15 further comprising a heat exchanger disposed between said hot zone enclosure and the blower intake whereby heat can be removed from the cooling gas during operation of the heat treating furnace.

17. A cylindrical hot zone enclosure for a heat treating furnace comprising:

A. a side wall and first and second end walls, wherein, said side wall has first and second slots formed therethrough and along the length thereof; and B. first and second elongated baffles disposed over the first and second slots, respectively, and means for supporting said first and second baffles in spaced relation from said first and second slots.

18. A hot zone enclosure for a heat treating furnace comprising:

A. a side wall and first and second end walls, wherein, said side wall has first and second slots formed therethrough and along the length thereof; and B. first and second elongated baffles disposed over the first and second slots, respectively, and means for supporting said first and second baffles in spaced relation from said first and second slots.

19. The hot zone enclosure of claim 17 or 18 further comprising a plenum formed around said hot zone enclosure, said plenum having an end wall disposed in parallel relation to the second end wall of said hot zone enclosure, said plenum end wall having first and second openings formed therein such that said first opening is positioned in proximate relation to the first slot and said second opening is positioned in proximate relation to said second slot;

a first damper disposed in proximate relation to the first opening for regulating flow of the cooling gas therethrough; and a second damper disposed in proximate relation to the second opening for regulating flow of the cooling gas therethrough.

20. The hot zone enclosure of claim 17 wherein the side wall of the hot zone enclosure has a third slot formed through said hot zone enclosure and along the length thereof.

21. A hot zone enclosure for a heat treating furnace comprising:

A. a side wall and first and second end walls, wherein, said side wall has first, second and third slots formed therethrough and along the length thereof; and B. first, second, and third elongated baffles disposed over the first, second, and third slots, respectively, and means for supporting said first, second, and third baffles in spaced relation from said first, second, and third slots, respectively.

22. The hot zone enclosure of claim 20 wherein the first, second, and third slots are spaced from one another.

23. The hot zone enclosure of claim 22 comprising:

a first damper disposed in proximate relation to the first opening for regulating flow of the cooling gas therethrough;

a second damper disposed in proximate relation to the second opening for regulating flow of the cooling gas therethrough; and a third damper disposed in proximate relation to the third opening for regulating flow of the cooling gas therethrough.

24. The hot zone enclosure of claim 20 wherein the side wall of the hot zone enclosure has a fourth slot formed through said hot zone enclosure and along the length thereof.

25. A hot zone enclosure for a heat treating furnace comprising:

A. a side wall and first and second end walls, wherein, said side wall has first, second, third and fourth slots formed therethrough and along the length thereof; and B. first, second, third, and fourth elongated baffles disposed over the first, second, third, and fourth slots, respectively, and means for supporting said first, second, third, and fourth baffles in spaced relation from said first, second, third, and fourth slots, respectively.

26. The heat treating furnace of claim 24 wherein the first, second, third, and fourth slots are spaced from one another.

27. The hot zone enclosure of claim 24 comprising:

a first damper disposed in proximate relation to the first opening for regulating flow of the cooling gas therethrough;

a second damper disposed in proximate relation to the second opening for regulating flow of the cooling gas therethrough;

a third damper disposed in proximate relation to the third opening for regulating flow of the cooling gas therethrough; and a fourth damper disposed in proximate relation to the fourth opening for regulating flow of the cooling gas therethrough.

28. The hot zone enclosure of claim 26 wherein the first and second slots are positioned diametrically opposite one another and the third and fourth slots are positioned diametrically opposite one another.

29. A heat treating furnace for providing directional cooling of a workpiece load, comprising:

A. a hot zone enclosure having a side wall and first and second end walls, wherein said side wall has first and second slots formed therethrough and along the length thereof;

B. means for removing a cooling gas from the hot zone enclosure, said means comprising a plenum extending circumferentially around said hot zone enclosure, said means further comprising a plenum end wall disposed in generally parallel relation to the second end wall of said hot zone enclosure;

C. first and second dampers disposed in said plenum end wall in a coplanar arrangement generally parallel to the second end wall of the hot zone enclosure, said first damper being positioned more proximate to the first slot than the second slot, and said second damper being positioned more proximate to said second slot than said first slot; and D. means for selectively moving one or both of said first and second dampers between an open position and a closed position.

30. The heat treating furnace of claim 29, comprising a means for injecting a cooling gas into the hot zone through said hot zone enclosure.

31. The heat treating furnace of claim 30, wherein the means for injecting a cooling gas comprises a plurality of nozzles extending through the side wall of said hot zone enclosure, said nozzles each comprising a flap valve that permits forced flow of the cooling gas into the hot zone, but impedes unforced flow of a heat treating gas out of the hot zone.

32. The heat treating furnace of claim 29, wherein the first slot is positioned diametrically opposite the second slot in the side wall of said hot zone enclosure.

33. The heat treating furnace of claim 29, comprising:

A. first and second elongated baffles disposed over the first and second slots, respectively, and B. means for supporting said first and second baffles in spaced relation from said first and second slots.

34. The heat treating furnace of claim 29 wherein the side wall of the hot zone enclosure has a third slot formed through said hot zone enclosure and extending along the length thereof.

35. The heat treating furnace of claim 34 comprising first, second, and third elongated baffles disposed over the first, second, and third slots, respectively, and means for supporting said first, second, and third baffles in spaced relation from said first, second, and third slots, respectively.

36. The heat treating furnace of claim 34, wherein said plenum end wall comprises a third damper positioned in proximate relation to said third slot.

37. The heat treating furnace of claim 29 wherein the side wall of the hot zone enclosure has a third slot and a fourth slot, said third and fourth slots formed through said hot zone enclosure and extending along the length thereof.

38. The heat treating furnace of claim 37 comprising a third elongated baffle disposed over the third slot, a fourth elongated baffle disposed over the fourth slot, means for supporting the third baffle in spaced relation from said third slot, and means for supporting said fourth baffle in spaced relation from said fourth slot.

39. The heat treating furnace of claim 37, wherein said plenum end wall comprises a third damper positioned in proximate relation to said third slot, and a fourth damper positioned in proximate relation to said fourth slot.

40. The heat treating furnace of claim 37, wherein the first and second slots are positioned diametrically opposite one another and the third and fourth slots are positioned diametrically opposite one another.

* * * * *